US008061557B1

(12) United States Patent
Torrance

(10) Patent No.: US 8,061,557 B1
(45) Date of Patent: Nov. 22, 2011

(54) GOLF BALL DISPENSER FOR GOLF BAG

(76) Inventor: Joshua Torrance, Hamburg, NY (US)

( * ) Notice: Subject to any disclaimer, the term of this patent is extended or adjusted under 35 U.S.C. 154(b) by 268 days.

(21) Appl. No.: 12/387,135

(22) Filed: Apr. 28, 2009

Related U.S. Application Data

(60) Provisional application No. 61/125,511, filed on Apr. 28, 2008.

(51) Int. Cl.
*B65D 85/00* (2006.01)

(52) U.S. Cl. ..... 221/185; 221/155; 221/302; 221/267

(58) Field of Classification Search ..... 221/185, 221/302, 155, 267
See application file for complete search history.

(56) References Cited

U.S. PATENT DOCUMENTS

| | | | | | |
|---|---|---|---|---|---|
| 1,576,010 | A | * | 3/1926 | Swartz | 221/281 |
| 1,754,495 | A | | 4/1930 | Anderson | |
| 1,829,093 | A | * | 10/1931 | Hollins | 206/315.5 |
| 2,664,933 | A | * | 1/1954 | Gielow | 206/315.5 |
| 3,281,013 | A | | 10/1966 | Motard | |
| 3,777,933 | A | * | 12/1973 | Joliot | 221/309 |
| 4,082,209 | A | * | 4/1978 | Sanders | 224/274 |
| 4,299,345 | A | * | 11/1981 | Lanzl | 224/666 |
| D277,709 | S | | 2/1985 | Toriumi | |
| 4,629,235 | A | * | 12/1986 | Logue | 294/19.2 |
| D300,447 | S | | 3/1989 | Timleck | |
| D321,921 | S | | 11/1991 | Johnson | |
| 5,183,154 | A | * | 2/1993 | Slemp | 206/315.9 |
| D353,180 | S | | 12/1994 | Dunning | |
| D362,037 | S | | 9/1995 | Kaye et al. | |
| 5,833,091 | A | * | 11/1998 | Palmer | 221/256 |
| 6,481,595 | B1 | * | 11/2002 | Chilton | 221/185 |
| 2002/0092862 | A1 | * | 7/2002 | Threadgill, Jr. | 221/283 |
| 2007/0034641 | A1 | * | 2/2007 | Huang | 221/269 |
| 2007/0241128 | A1 | * | 10/2007 | Smith | 221/281 |

* cited by examiner

*Primary Examiner* — Patrick Mackey
(74) *Attorney, Agent, or Firm* — Montgomery Patent & Design; Robert C. Montgomery; Joseph T. Yaksich

(57) ABSTRACT

A golf ball dispenser which attaches to the exterior surface of a golf bag that is upright, rectangular, and capable of holding a plurality of golf balls, is herein disclosed. The dispenser is made of a durable yet flexible plastic material. Stored balls are added through the top of the dispenser through an upper opening. The balls can either be inserted one (1) at a time or in "as-purchased" quantities. In use, to remove a golf ball, the lowest ball is forced upward through a flexible retaining tab, thus releasing the ball through a bottom aperture. The dispenser is attachable to a golf bag with a fastening means.

17 Claims, 8 Drawing Sheets

GOLF BALL DISPENSER FOR GOLF BAG

RELATED APPLICATIONS

The present invention was first described in and claims the benefit of U.S. Provisional Application No. 61/125,511, filed Apr. 28, 2008, the entire disclosures of which are incorporated herein by reference.

FIELD OF THE INVENTION

The present invention relates generally to an accessory for a golf bag, and more specifically, to a golf ball dispenser that is attachable to a golf bag.

BACKGROUND OF THE INVENTION

The game of golf has become one (1) of the most popular sports in the world. Golfers of all skill levels are constantly looking for ways to improve their games and make a day on the course more enjoyable and thus, golf accessory manufacturers are always looking for ways to satisfy this desire. One (1) of the most common and important golf accessories is the golf ball. During a regular game of golf, balls are easily lost or damaged and regularly need to be replaced.

For many casual golfers, a good day on the course is directly related to how many golf balls they loose or find. Additionally, many golfers prefer to use cheaper balls when teeing off, around water hazards, or for other shots where the likely hood of loosing the golf ball is increased; keeping the better golf balls for situations where precision and accuracy is of the utmost importance, such as chip shots and putting. This practice usually requires a golfer to fumble through a golf bag searching for the ball of choice or keeping multiple balls in their pockets during the game, which is inconvenient and uncomfortable.

A variety of attempts have been made to overcome these disadvantages and provide a means to contain and dispense a plurality of golf balls in a convenient and efficient manner. These attempts include various tubular golf ball holders where the golf balls are vertically stacked and dispensed one at a time from a golf ball holder housing during game play, practice, or the like when a ball needs to be replaced. The attempts typically encounter various disadvantages including: inconvenient and restrictive methods of mounting or carrying the holder, cumbersome mechanisms used to retain and dispense the balls, dispensing mechanisms that oppose the force being exerted by the stacking of balls within the holder often causing the dispensing means to malfunction, the inability to determine how many if any balls are actually stored within the holder, or multiple components that require a user to assembly the holder to manipulate parts when a golf ball is to be inserted or removed. Among the typical relevant attempts are several U.S. Patents.

U.S. Pat. No. 1,754,495, issued in the name of Anderson, describes a golf ball holder comprising an elongated hollow container suited to carry a plurality of golf balls, an open end, an open end closure cap, and a carrying strap.

U.S. Pat. No. 1,829,093, issued in the name of Hollins, describes a golf bag and attachment therefore comprising an elongated tubular pocket that is attachable to an inside portion of golf bag beside the club storage space that holds a column of golf balls.

U.S. Pat. No. 3,281,013, issued in the name of Motard, describes a golf ball dispenser comprising a hollow tubular magazine suitably sized to receive a golf ball that is open on both ends having a dispensing unit at one (1) of the open ends.

The dispensing unit comprises two (2) offset arcuate gate members that positioned such that when the dispensing unit is engaged one (1) gate member leaves the lower end of the tubular magazine open thus dispensing the lower ball while the other gate member obstructs the path of the superjacent ball. When the dispensing unit is disengaged a spring returns it to the original position allowing the remaining balls within the magazine to be displaced into a lowered dispensing position.

U.S. Pat. No. 4,082,209, issued in the name of Sanders, describes a golf ball holder comprising a cylindrical housing having an upper retaining chamber and lower dispensing chamber, a dispensing opening on the lower end of the housing suitably sized to allow a golf ball to pass through, and a retaining finger that prevents the golf balls from fully dropping into the dispensing chamber. Golf balls are laterally moved within the chamber to a lower and dispensing position when the retaining finger is depressed.

Additionally, ornamental designs for golf ball holders and dispensers exist, particularly, U.S. Pat. Nos. D 277,709; D 300,447; D 321,921; D 353,180 and D 362,037. However, none of these designs are similar to the present invention.

While these devices fulfill their respective, particular objectives, each of these references suffers from one (1) or more of the aforementioned disadvantages. Accordingly, to satisfy the equipment needs of the golfing public, manufacturers are constantly looking for new and improved golf equipment designed to not only improve one's score but the enjoyment of the game as a whole. The development of the invention herein described substantially departs from the conventional solutions and in doing so fulfills this need.

SUMMARY OF THE INVENTION

In view of the foregoing references, the inventor recognized the aforementioned inherent problems and observed that there is a need for a means to store, transport, and dispense golf balls during a game of golf in a manner that is easy and effective and thus, the object of the present invention is to solve the aforementioned disadvantages.

To achieve the above objectives, it is an object of the present invention to provide a golf ball dispenser for a golf bag that provides a removable compartment to arrange and dispense a plurality of golf balls in an orderly fashion.

Another object of the golf ball dispenser is to provide a device comprising a front panel, a front opening, a pair of side panels, a rear panel, a top opening, a bottom panel, and a clip. The device retains a capacity of approximately six (6) golf balls and is simply attached to a golf bag, a belt, or the like via a clip. The device is fabricated from a durable plastic material and may be introduced in a variety of colors, patterns, and textures to suit a user's preference or to match a user's golf bag color.

Yet still another object of the golf ball dispenser is to provide a front panel comprising an integral viewing window that provides a simple visual display indicating the number of golf balls that are present within the device.

Yet still another object of the golf ball dispenser is to provide a front panel comprising a ball dispensing front opening along a lower area that provides a means for a controlled extraction of golf balls. The front opening comprises a flexible retaining tab along a bottom edge of the front opening that provides a mechanical retaining barrier that retains the golf balls inside the device until needed. When needed, a golf ball is manually forced over the retaining tab.

Yet still another object of the golf ball dispenser is to provide a retaining tab that physically distorts frontwardly when a golf ball is removed and returns to an original vertical position to immediately retain the remaining stacked golf balls due to its flexible composition.

Yet still another object of the golf ball dispenser is to provide a top opening for easy loading of golf balls and an interior shape suited to confine a plurality of stacked golf balls in a vertical manner upon a bottom panel. The top opening further comprises a pair of flexible retaining strips that assist in securely holding the golf balls contained within the device.

Yet another object of the golf ball dispenser is to provide retaining strips comprising horizontal elements affixed to and extending between the top edges of the side panels.

Yet still another object of the golf ball dispenser is to provide a method of utilizing the device which provides increased functionality and ease of play for all golfers in a manner which is quick, easy, and effective.

Further objects and advantages of the golf ball dispenser will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
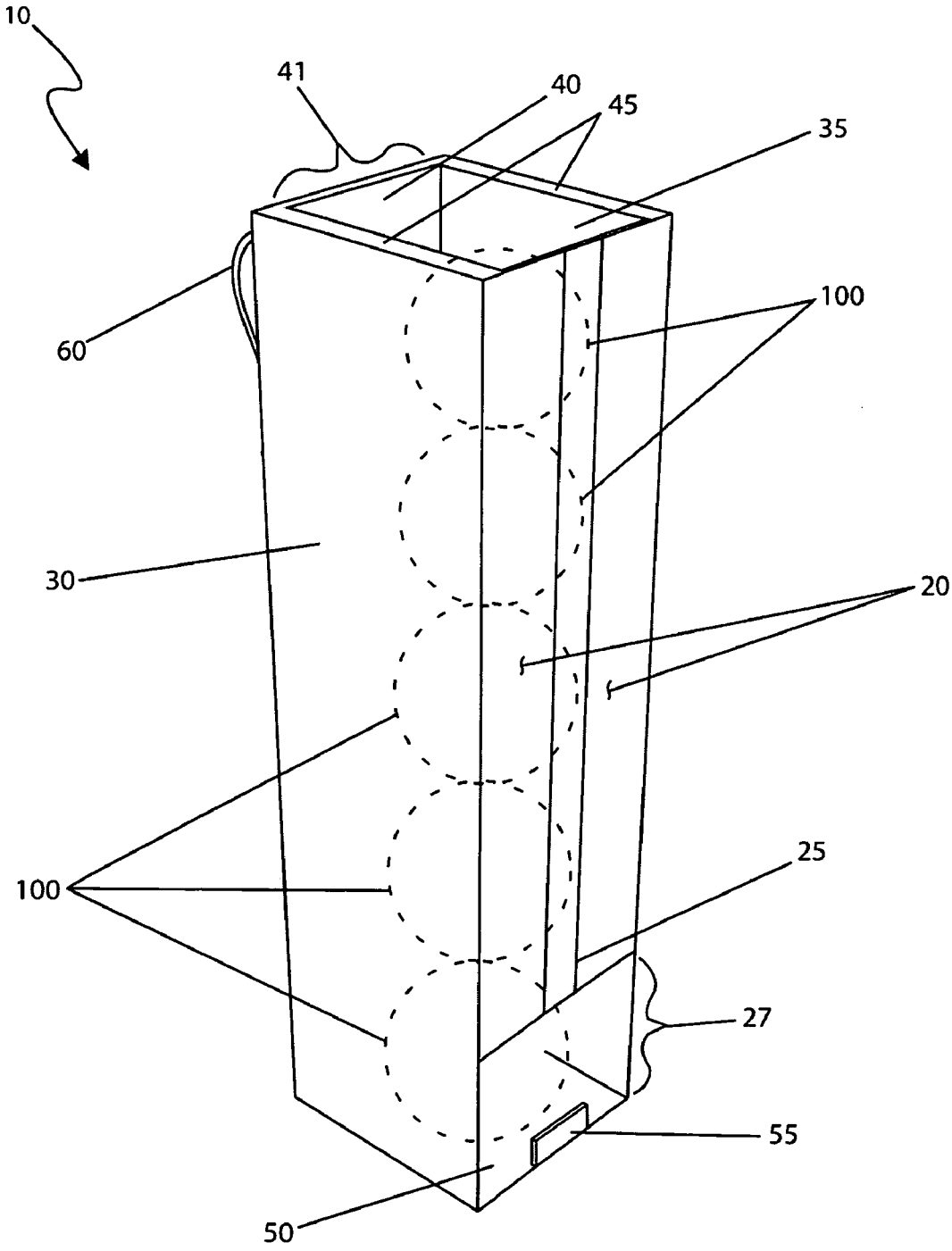
FIG. 1 is a front perspective view of a golf ball dispenser for a golf bag 10, according to a preferred embodiment of the present invention.

| DESCRIPTIVE KEY | |
|---|---|
| 10 | golf ball dispenser for a golf bag |
| 20 | front panel |
| 25 | window |
| 27 | front opening |
| 30 | first side panel |
| 35 | second side panel |
| 40 | rear panel |
| 41 | top opening |
| 45 | retaining strips |
| 50 | bottom panel |
| 55 | tab |
| 60 | clip |
| 65 | fastener |
| 100 | golf ball |

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a golf ball dispenser for a golf bag (herein described as the "device") 10, thereby providing a compartment thereto arrange and distribute golf balls 100 in an orderly fashion. Said device 10 comprises a front panel 20, a front opening 27, a pair of side panels 30, 35, a rear panel 40, a top opening 41, a bottom panel 50, a clip 60, and a plurality of golf balls 100. Said device 10 retains a capacity of approximately six (6) golf balls 100 and is attached thereto a golfing bag. The device 10 is fabricated from a durable plastic material and may be introduced in a variety of colors, patterns, and textures to suit a user's preference or to match a user's golf bag color.

Referring now to FIG. 1, a front perspective view of the device 10 and FIGS. 3 through 8, front, rear, sides, top and bottom views of the device 10, according to the preferred embodiment of the present invention, are disclosed. The device 10 comprises a molded plastic assembly forming a rectangular enclosure approximately twelve (12) inches high and two (2) inches square in cross-section. The device 10 further comprises a front panel 20, a window 25, a first side panel 30, a second side panel 35, a rear panel 40, and a bottom panel 50. The device 10 is purchased pre-loaded with new golf balls 100 and subsequently loaded with additional golf balls 100 either one (1) at a time or in "as-purchased" quantities, of which there are typically three (3) golf balls 100.

The device 10 comprises a front panel 20 further comprising an integral window 25, thereby providing a visual display thereto a present amount of golf balls 100 therein the device 10 to a user. Said window 25 comprises a transparent plastic strip extending vertically the height of the front panel 20 and being centrally located thereto. The window 25 is approximately one (1) inch wide and affixed thereto said front panel 20 using a common plastic welding process.

The front panel 20 also comprises a ball dispensing front opening 27 along a lower area, thereby providing a controlled extraction of golf balls 100 therefrom. Said front opening 27 comprises a flexible retaining tab 55 along a bottom edge region of the front opening 27 which provides a mechanical retaining barrier approximately one (1) inch wide and one-half (½) inch high, thereby retaining golf balls 100 therein the device 10 until needed. When needed for play, a golf ball 100 is manually forced over said tab 55 which is distorts frontwardly and returns to its original shape and vertical position due to its flexible plastic composition, thereby retaining remaining golf balls 100 therewithin the device 10.

The device 10 provides a top opening 41 for easy loading of golf balls 100 and an interior shape so as to confine and provide a stacking of the golf balls 100 in a vertical manner thereupon a bottom panel 50, thereby providing a convenient counting means when said golf balls 100 are viewed through the window 25 of the front panel 20. Said top opening 41 also provides a pair of flexible retaining strips 45 to aid in holding golf balls 100 contained therewithin during use. Said retaining strips 45 are horizontal elements approximately one-half (½) inch wide affixed thereto top edges of the first 30 and second 35 side panels and extending therebetween and being affixed thereto the front 20 and rear 40 panels.

Figure 2:
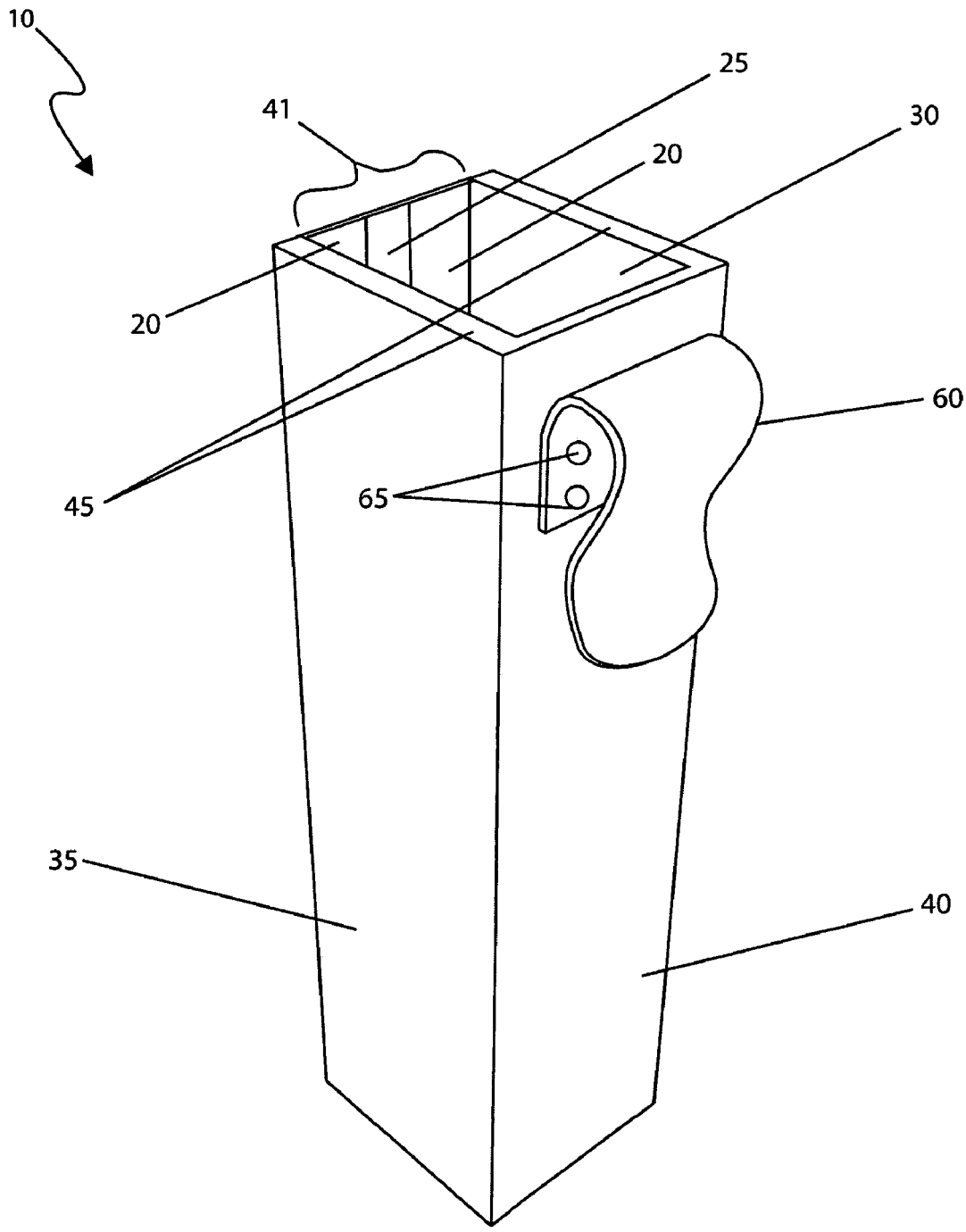
FIG. 2 is a rear perspective view of the golf ball dispenser for a golf bag 10, according to a preferred embodiment of the present invention.

Referring now to FIG. 2, a rear perspective view of the device 10 and FIGS. 3 through 8, front, rear, first side, second side, top and bottom views of the device 10, according to the preferred embodiment of the present invention, are disclosed. The device 10 comprises a golf bag attaching clip 60 providing removable attachment thereto an exterior surface of a golf bag using a spring-type clip 60 or other attachment means. Said clip 60 would be provided as either original equipment or aftermarket equipment for common golf bags. Said clip 60 takes the form of a metal fixture in an inverted "U"-shape and affixed thereto the rear panel 40 via a fastening means such as rivets, screws, or the like. The clip 60 is made using chrome-plated spring steel or other equivalent corrosion resistant materials. Although depicted here as a top-hooking fixture, the clip 60 may be provided in various forms such as, but not limited to: a clamping device, spring-loaded latch, strap/buckle device, or the like without deviating from the concept and as such should not be interpreted as a limiting factor of the device 10.

It is envisioned that other styles and configurations of the present invention can be easily incorporated into the teachings of the present invention, and only one particular configuration shall be shown and described for purposes of clarity and disclosure and not by way of limitation of scope.

Figure 3:
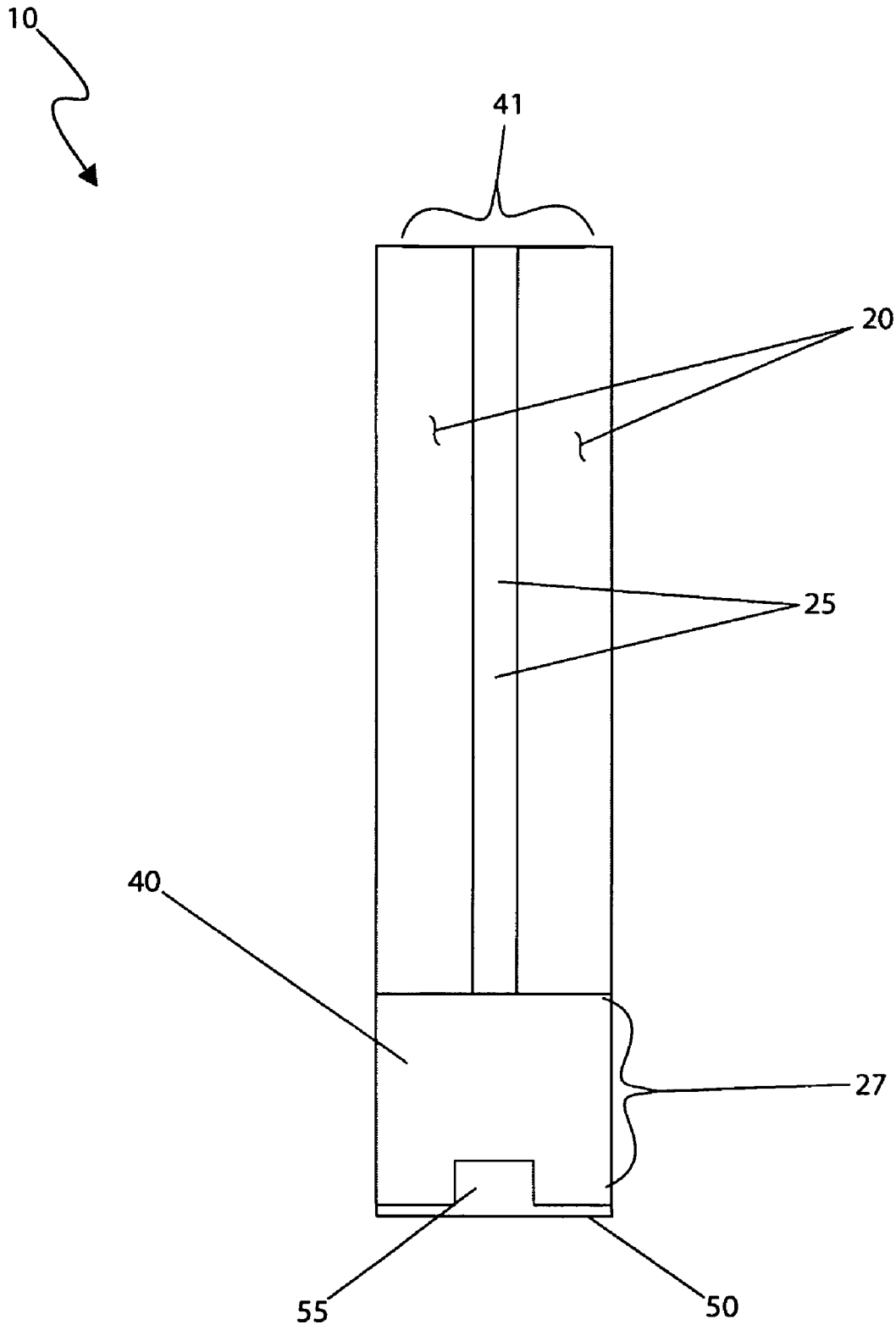
FIG. 3 is a front view of the golf ball dispenser for a golf bag 10, according to a preferred embodiment of the present invention.
Figure 4:
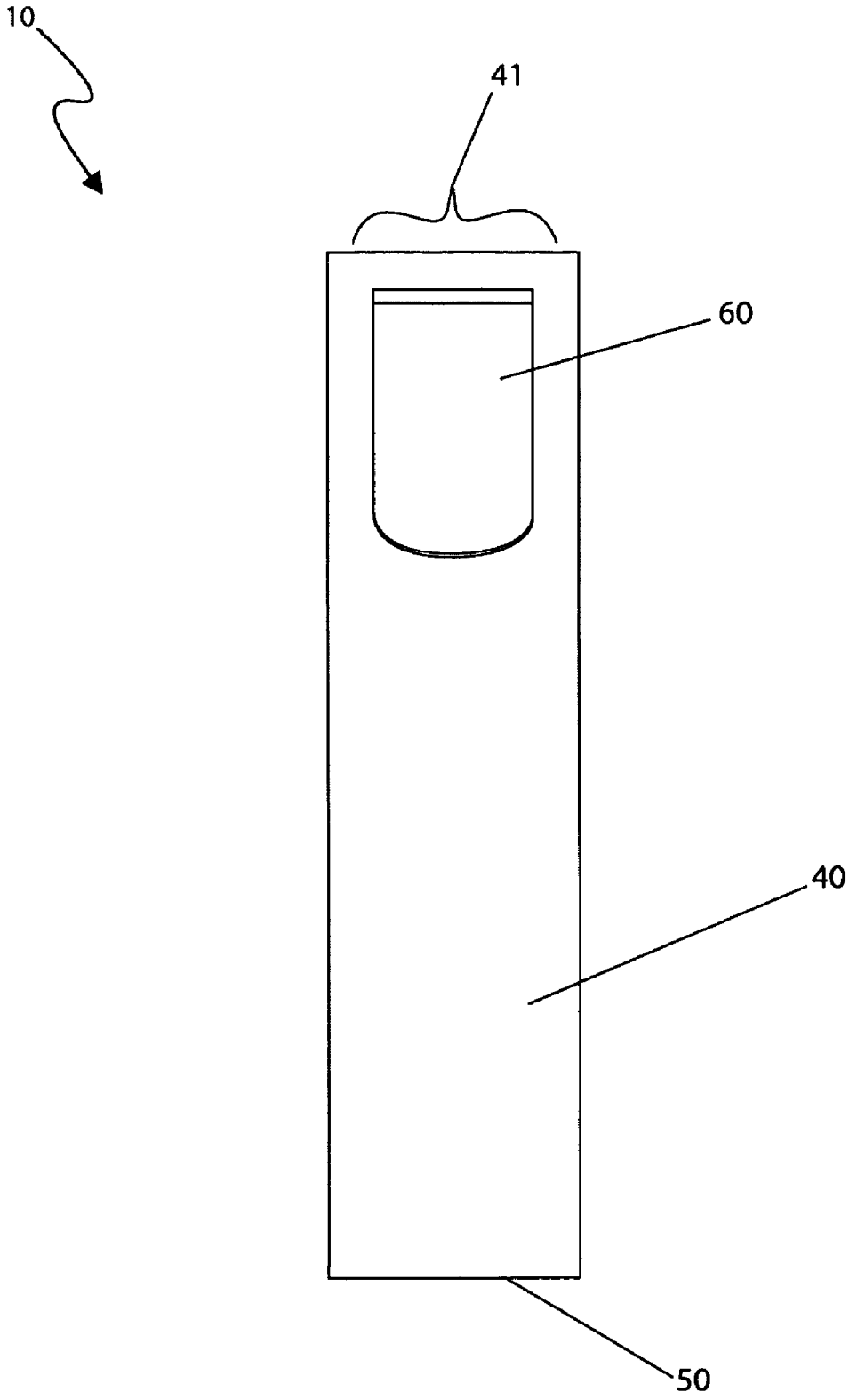
FIG. 4 is a rear view of the golf ball dispenser for a golf bag 10, according to a preferred embodiment of the present invention.
Figure 5:
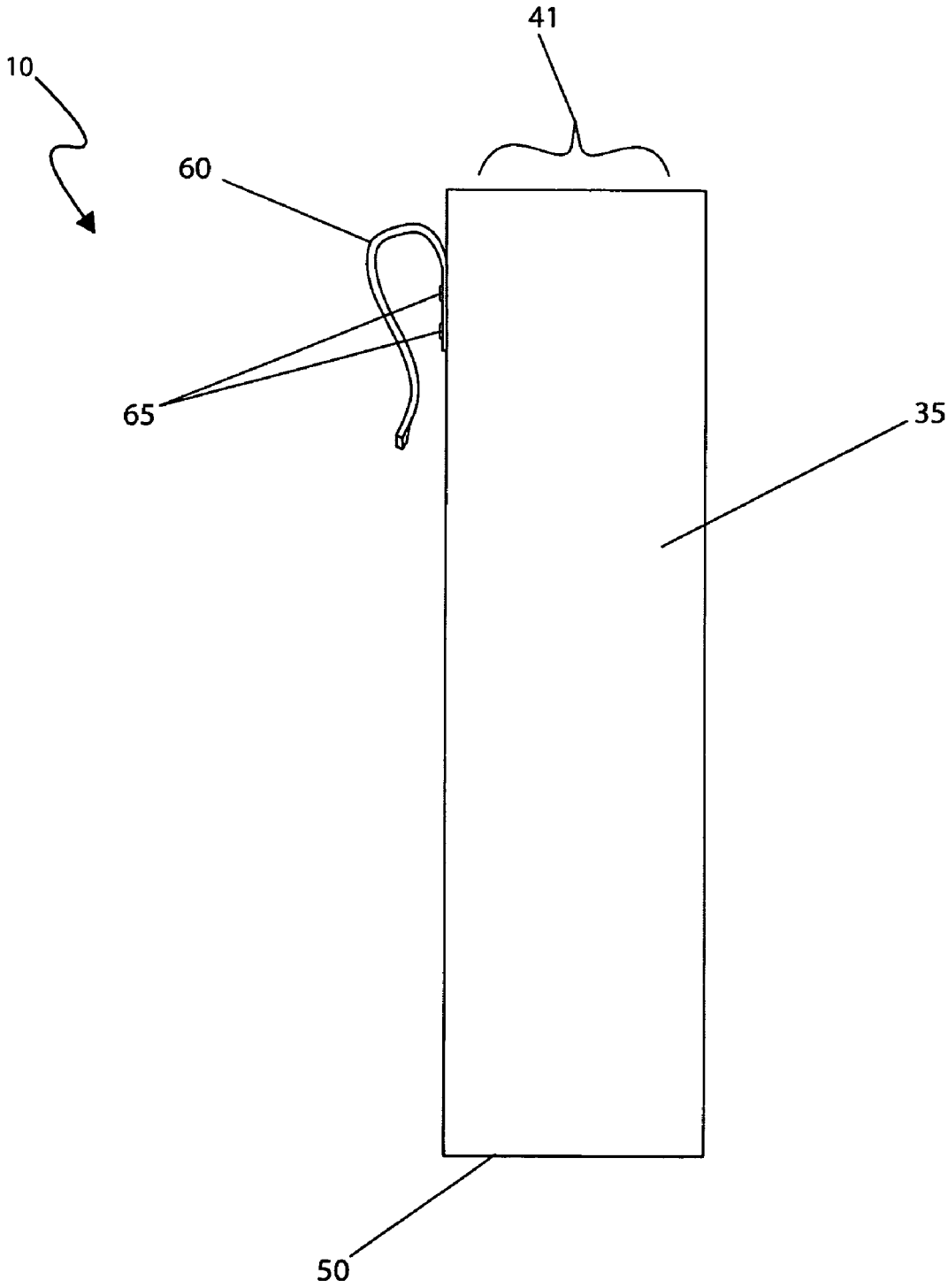
FIG. 5 is a first side view of the golf ball dispenser for a golf bag 10, according to a preferred embodiment of the present invention.
Figure 6:
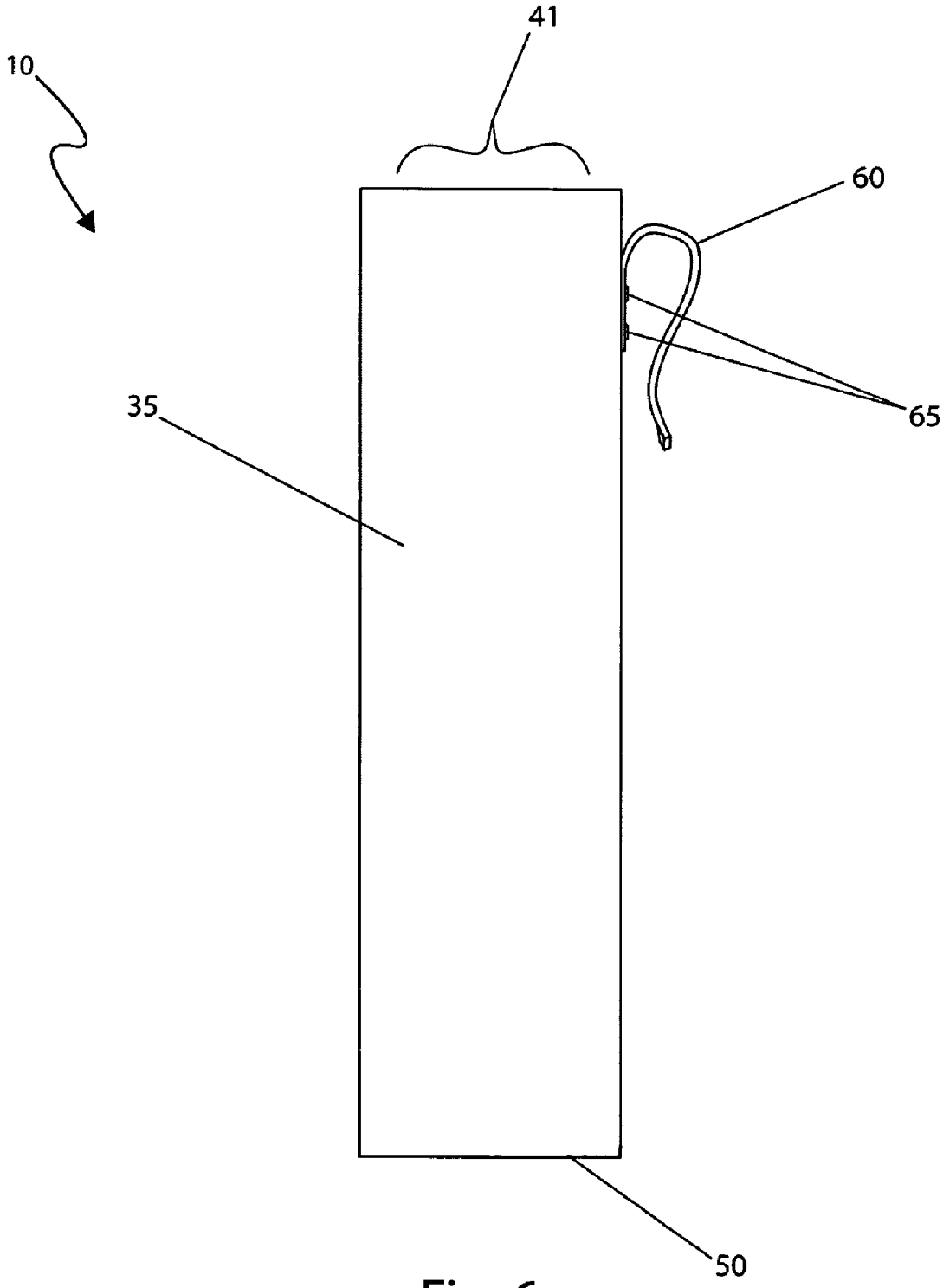
FIG. 6 is a second side view of the golf ball dispenser for a golf bag 10, according to a preferred embodiment of the present invention.
Figure 7:
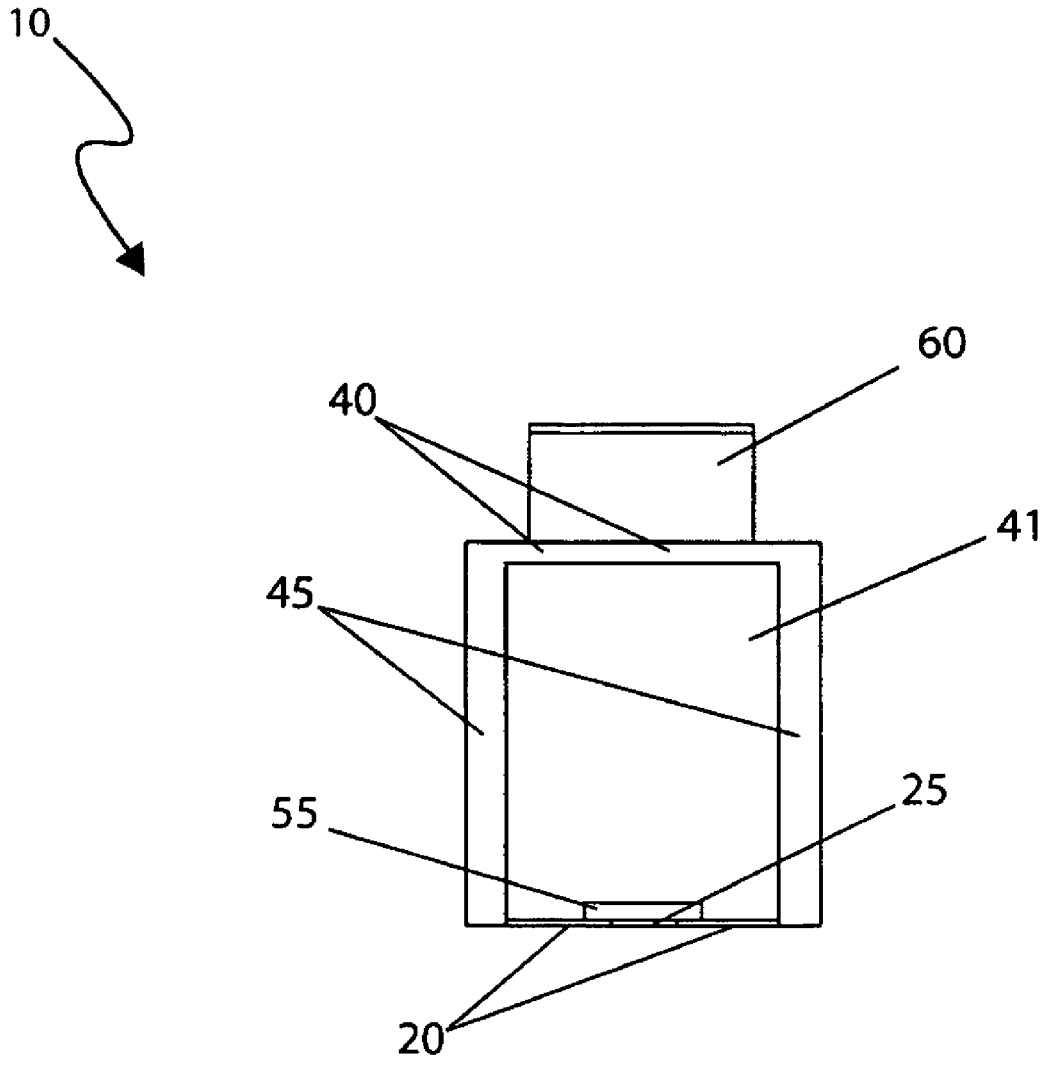
FIG. 7 is a top view of the golf ball dispenser for a golf bag 10, according to a preferred embodiment of the present invention; and, FIG. 8 is a bottom view of the golf ball dispenser for a golf bag 10, according to a preferred embodiment of the present invention.
Figure 8:
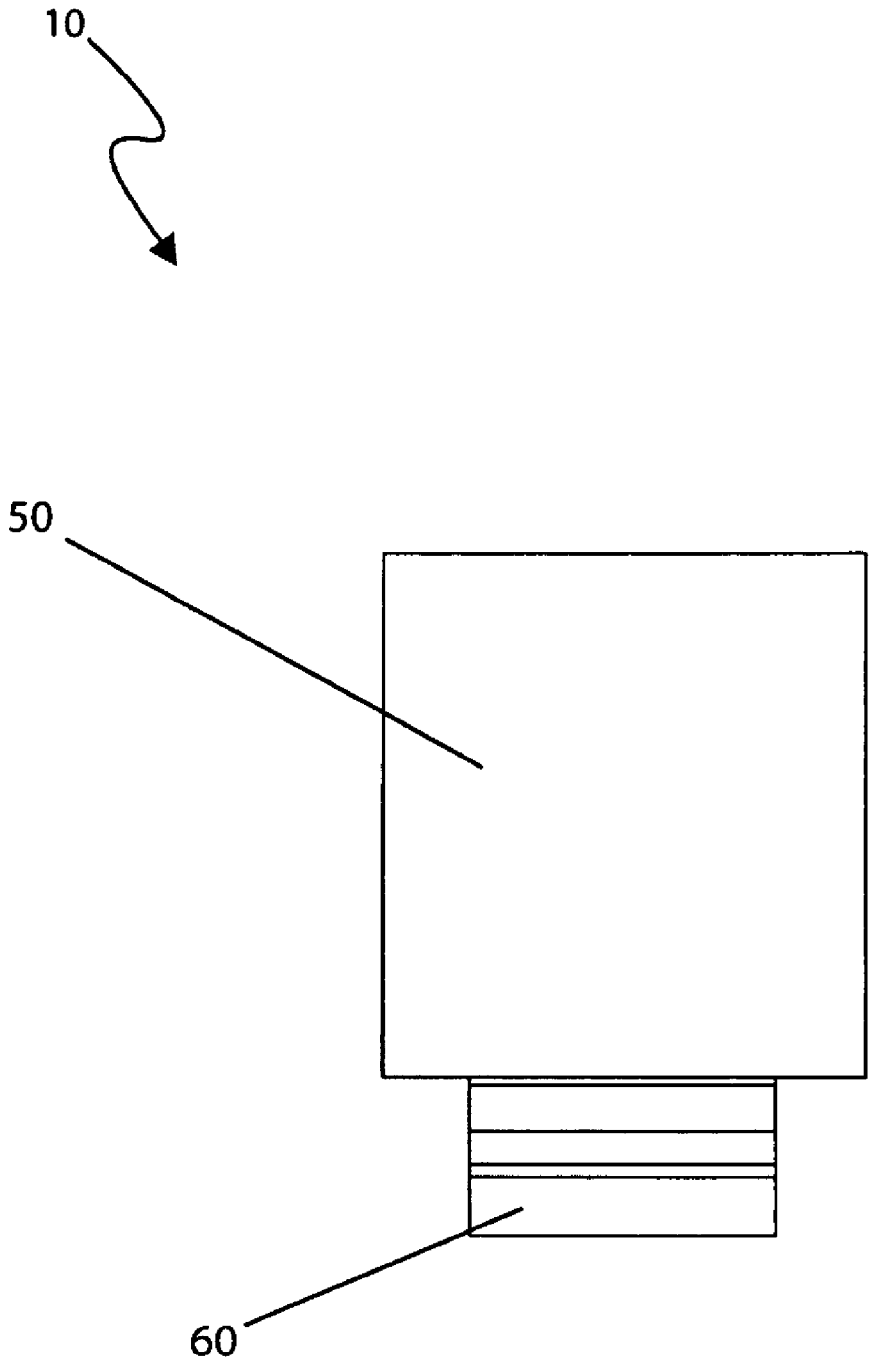

The preferred embodiment of the present invention can be utilized by the common user in a simple and effortless manner with little or no training. After initial purchase or acquisition of the device 10, it would be provided as indicated in FIGS. 1 and 3.

The method of utilizing the device 10 may be achieved by performing the following steps: purchasing the device 10 pre-loaded and packaged with up to six (6) new golf balls 100; attaching the device 10 securely thereto a convenient golf bag feature such as a top edge, a side pocket, or another upward directed edge thereupon therewith the clip 50; dispensing golf balls 100 as needed therefrom the front opening 27, thereby grasping and forcing a single golf ball 100 past the tab 55 as needed; visually observing a current amount of golf balls 100 stored by said device 10 therethrough the window 25; repeating a dispensing of golf balls 100 until the device 10 is exhausted of balls 100; loading additional golf balls 100 therein the device 10 therethrough the top opening 41 by forcing said balls 100 through the retaining strips 45 one at a time or in "as-purchased" quantities, as desired; and, benefiting from increased convenience while obtaining a new golf ball 100 for play using the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A dispenser for a plurality of golf balls, further comprising:

a durable and resilient rectangular enclosure comprising a unitary body for retaining said plurality of golf balls, comprising a top opening located thereat an upper portion, a front panel with a front opening located thereat a bottom portion thereof, a pair of opposing side panels each attached thereto said front panel, a rear panel attached to each of said pair of opposing side panels, a bottom panel, and a retention means;

wherein said enclosure is shaped to provide a confining and stacking means thereto said plurality of golf balls;

wherein said enclosure further comprises a molded plastic assembly approximately twelve inches in height and two inches square in cross-section;

wherein said top opening comprises a corresponding size to receive said plurality of golf balls;

wherein said front opening comprises a corresponding size to dispense to said plurality of golf balls;

wherein said retention means retains said plurality of golf balls within said enclosure prior to a dispensing means;

wherein said dispensing means dispenses said plurality of golf balls individually in succession;

wherein said dispenser stores said plurality of golf balls; and, wherein said dispenser is refillable with an additional quantity of said plurality of golf balls.

2. The dispenser of claim 1, further comprising a window centrally-located thereof said front panel and affixed thereto;

wherein said window comprises a viewing means thereto a quantity of said plurality of golf balls retained therein said dispenser.

3. The dispenser of claim 2, wherein said window further comprises a transparent plastic strip extending vertically the height of said front panel suprajacent thereto said front opening.

4. The dispenser of claim 1, wherein said retention means further comprises a flexible retaining tab along a bottom edge region of said bottom panel minimally extending upwardly into said front opening;

wherein said retaining tab is suitably sized to retain said plurality of golf balls from inadvertent dispensing therethrough said front opening.

5. The dispenser of claim 4, wherein said retaining tab is approximately one inch in width and one-half inch in height.

6. The dispenser of claim 1, further comprising a pair of retaining strips each affixed thereto a top edge of said pair of opposing side panels and extending therebetween and affixed thereto said front panel and said rear panel;

wherein said pair of retaining strips provides an upper retention means thereto said plurality of golf balls.

7. The dispenser of claim 6, wherein said pair of retaining strips each further comprise a flexible horizontal element approximately one-half inch in width.

8. The dispenser of claim 1, further comprising an attachment means affixed thereto an outer surface thereof said rear panel;

wherein said attachment means removably attaches said dispenser thereto a support structure.

9. The dispenser of claim 8, wherein said attachment means further comprises a corrosion-resistant resilient clip.

10. The dispenser of claim 1, wherein said enclosure is sized to hold up to six golf balls.

11. A dispenser for a plurality of golf balls, further comprising:

a durable and resilient rectangular enclosure for retaining said plurality of golf balls, further comprising:

a unitary body comprising a front panel with a front opening at a bottom location thereof, a pair of opposing side panels each attached thereto said front panel, a rear panel attached to each of said pair of opposing side panels, a bottom panel, and a top opening;

a window centrally-located thereof said front panel and affixed thereto, providing a viewing means thereto a quantity of said plurality of golf balls retained therein said dispenser;

a flexible retaining tab along a bottom edge region of said bottom panel minimally extending upwardly into said front opening; and, a pair of retaining strips each affixed thereto a top edge of said pair of opposing side panels and extending therebetween and affixed thereto said front panel and said rear panel; and, an attachment means affixed thereto an outer surface thereof said rear panel;

wherein said enclosure is shaped to provide a confining and stacking means thereto said plurality of golf balls;

wherein said enclosure further comprises a molded plastic assembly approximately twelve inches in height and two inches square in cross-section;

wherein said top opening comprises a corresponding size to receive said plurality of golf balls;

wherein said front opening comprises a corresponding size to dispense to said plurality of golf balls;

wherein said retaining tab is suitably sized to retain said plurality of golf balls within said enclosure prior to a dispensing means;

wherein said pair of retaining strips provides an upper retention means thereto said plurality of golf balls;

wherein said dispensing means dispenses said plurality of golf balls individually in succession;

wherein said dispenser is refillable with an additional quantity of said plurality of golf balls; and, wherein said attachment means removably attaches said dispenser thereto a support structure.

12. The dispenser of claim 11, wherein said window further comprises a transparent plastic strip extending vertically the height of said front panel suprajacent thereto said front opening.

13. The dispenser of claim 11, wherein said retaining tab is approximately one inch in width and one-half inch in height.

14. The dispenser of claim 11, wherein said pair of retaining strips each further comprise a flexible horizontal element approximately one-half inch in width.

15. The dispenser of claim 11, wherein said attachment means further comprises a corrosion-resistant resilient clip.

16. The dispenser of claim 11, wherein said enclosure is sized to hold up to six golf balls.

17. A method of retaining a plurality of golf balls for individually dispensing an individual golf ball in succession within a dispenser comprises the following steps:

providing said dispenser, further comprising:

a durable and resilient rectangular enclosure for retaining said plurality of golf balls, further comprising:

a unitary body comprising a front panel with a front opening at a bottom location thereof, a pair of opposing side panels each attached thereto said front panel, a rear panel attached to each of said pair of opposing side panels, a bottom panel, and a top opening;

a window centrally-located thereof said front panel and affixed thereto, providing a viewing means thereto a quantity of said plurality of golf balls retained therein said dispenser;

a flexible retaining tab along a bottom edge region of said bottom panel minimally extending upwardly into said front opening; and, a pair of retaining strips each affixed thereto a top edge of said pair of opposing side panels and extending therebetween and affixed thereto said front panel and said rear panel; and, an attachment clip affixed thereto an outer surface thereof said rear panel;

wherein said enclosure further comprises a molded plastic assembly approximately twelve inches in height and two inches square in cross-section;

obtaining said dispenser retaining said plurality of golf balls therein;

attaching said dispenser securely thereto a support structure therewith said attachment clip;

dispensing a golf ball individually in succession therefrom said front opening by grasping and forcing a golf ball thereover said retaining tab;

observing said quantity of said plurality of golf balls therethrough said window;

repeating said dispensing step until said dispenser is empty; and, loading an additional plurality of golf balls therethrough said top opening by forcing said additional plurality of golf balls therethrough said pair of retaining strips individually in succession.

* * * * *